US008770573B2

(12) United States Patent
Kondo et al.

(10) Patent No.: US 8,770,573 B2
(45) Date of Patent: Jul. 8, 2014

(54) RECORDING DEVICE

(71) Applicant: Seiko Epson Corporation, Tokyo (JP)

(72) Inventors: Manabu Kondo, Nagano (JP); Yohei Nunokawa, Nagano (JP); Yasuhiko Yoshihisa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/950,779

(22) Filed: Jul. 25, 2013

(65) Prior Publication Data

US 2014/0027969 A1 Jan. 30, 2014

(30) Foreign Application Priority Data

Jul. 26, 2012 (JP) ..... 2012-165547

(51) Int. Cl.
*B65H 5/26* (2006.01)

(52) U.S. Cl.
USPC ..... 271/9.09; 271/9.01; 271/9.13

(58) Field of Classification Search
USPC ..... 271/9.01, 9.02, 9.09, 9.13
See application file for complete search history.

(56) References Cited

U.S. PATENT DOCUMENTS 5,159,387 A * 10/1992 Takahashi et al. ..... 355/50
5,228,680 A * 7/1993 Sugiura ..... 271/259
5,585,943 A * 12/1996 Kikuchi ..... 358/498
7,938,393 B2 * 5/2011 Yako ..... 271/9.09

FOREIGN PATENT DOCUMENTS

JP 2006-160431 A 6/2006

* cited by examiner

*Primary Examiner* — Ernesto Suarez
(74) *Attorney, Agent, or Firm* — Global IP Counselors, LLP

(57) ABSTRACT

To provide a recording device that can inhibit the occurrence of a recording media jam state in a shared passage part that is shared as a recording media shared path with a plurality of media supply paths, this is equipped with a plurality of conveyance paths for supplying paper, a shared passage part, a moving unit that moves the paper, a printing unit that performs printing on the paper, an insertion port that is able to insert paper in the conveyance path by paper being inserted, an opening and closing lid provided so that the insertion port can be opened and closed, a detection sensor for detecting an open lid state when the opening and closing lid opens the insertion port, and a movement control unit that, when the detection sensor detects the open lid state.

3 Claims, 7 Drawing Sheets

RECORDING DEVICE

CROSS-REFERENCE TO RELATED APPLICATIONS

This application claims priority to Japanese Patent Application No. 2012-165547 filed on Jul. 26, 2012. The entire disclosure of Japanese Patent Application No. 2012-165547 is hereby incorporated herein by reference.

BACKGROUND

1. Technical Field

The present invention relates to a recording device for supplying recording media from a plurality of media supply paths to a recording unit for performing recording on recording media.

2. Background Technology

From the past, recording devices have been put to practical use which are equipped with a recording unit for recording images including text or graphics on paper as an example of recording media by spraying liquid from a liquid spray head, for example. Specifically, this recording device has a paper feed cassette that can hold paper placed in a layered state, and performs recording by spraying liquid from the liquid spray head of the recording unit on the paper fed from that paper feed cassette and conveyed (supplied) along the paper conveyance path (media supply path).

For this type of recording device, there are also devices that are further equipped with a manual feed supply path separate from the media supply path for supplying paper housed in the paper feed cassette to the recording unit as the media supply path for supplying paper to the recording unit. The manual feed supply path has a supply port in which paper is inserted, and by the user manually inserting one sheet of paper at a time in the supply port, for example, this is a media supply path by which it is possible to supply paper one sheet at a time to the recording unit.

With a recording device equipped with a plurality of media supply paths in this way, there is a shared passage part that is normally shared as the paper supply path up to the recording unit with the respective media supply paths, and the constitution is such that the paper is supplied to the recording unit through this shared passage part. Because of this, with the recording device having the plurality of media supply paths, for example when the paper supplied from the paper feed cassette and the paper supplied by hand feeding from the supply port are simultaneously moved (conveyed) inside the shared passage part, there are cases when a paper jam state occurs.

In light of that, technology for inhibiting the occurrence of this kind of paper jam state has been proposed. For example, with Patent Document 1, whether or not paper has been inserted in the supply port (manual paper feed port) is detected by a sensor provided in the supply port, and in a state with paper inserted in the supply port, when supply of paper from the paper feed cassette (other paper feed port) is indicated, the paper inserted in the supply port is for the time being ejected to outside from the shared passage part (automatic paper ejection). Then, after that, the paper is made to be supplied to the recording unit via the shared passage part from the indicated media supply path (paper feed cassette). With this technology, it is possible to avoid having the paper supplied from the paper feed cassette and the paper supplied from the supply port simultaneously move (be conveyed) inside the shared passage part, so it is possible to inhibit the occurrence of a paper jam state.

Japanese Unexamined Patent Publication No. 2006-160431 (Patent Document 1) is an example of the related art.

SUMMARY

Problems to be Solved by the Invention

However, in recent years, there has been a demand for recording devices to be more compact, and in accordance with that, for the media supply path space to be smaller. Because of that, due to the smaller space of the manual feed supply path, as with the constitution disclosed in Patent Document 1, there are cases when it is not possible to arrange a sensor for detecting paper inserted in the supply port in the manual feed supply path. In such a case, it is not possible to detect whether paper has been inserted in the supply port, so when supply of paper from the paper feed cassette is indicated in a state with paper inserted in the supply port, it is possible for supply of paper from the paper feed cassette to be performed with the paper inserted in the supply port remaining not ejected. Because of this, by the paper in the state inserted in the supply port along with paper supplied from the paper feed cassette being supplied to the recording unit simultaneously, there is the problem of a paper jam state occurring within the shared passage part.

This kind of circumstance is not limited to recording devices equipped with a media supply path for supplying paper to the recording unit from the paper feed cassette and a manual feed supply path for supplying paper inserted in the supply port to the recording unit, but was generally common to recording devices equipped with a plurality of media supply paths having a shared passage part shared as the supply path of the recording media up to the recording unit.

The invention was created considering the circumstances noted above, and a main advantage is to provide a recording device that can inhibit the occurrence of a recording media jam state at the shared passage part shared as a supply path of the recording media with a plurality of media supply paths.

Means Used to Solve the Above-Mentioned Problems

The recording device for addressing the problems above is equipped with a plurality of media supply paths for supplying recording media, a shared passage part shared by the plurality of media supply paths, a moving unit that moves the recording media, a recording unit that performs recording on recording media supplied through the shared passage part, a supply port that, with at least one of the media supply paths of the plurality of media supply paths, is able to supply that recording media to that media supply path by recording media being inserted, a lid member provided so that the supply port can be opened and closed, an open lid detection unit for detecting an open lid state when the lid member opens the supply port, and a movement control unit that, when the open lid detection unit detects the open lid state, before supplying of recording media is performed to the recording unit from another media supply path other than the media supply path on which the supply port is provided for which the open lid state is detected, drives the moving unit to perform the operation of moving the recording media to outside the shared passage part regardless of whether or not at least a portion of the recording media exists in the shared passage part.

With this constitution, even when it is not possible to arrange a sensor for detecting recording media in the media supply path in which the supply port is provided, by detecting that the lid member is in an open lid state, it is possible to detect that the recording media is in a state inserted in the media supply path from the supply port. Then, the recording media in a state inserted in the media supply path from the supply port is moved to be evacuated to outside the shared passage part when recording media is supplied to the recording unit from another media supply path other than the media supply path in which the supply port is provided. Because of that, the recording media inserted via the supply port to the media supply path in which the supply port is provided does not obstruct the supply of recording media supplied to the recording unit through the shared passage part from another media supply path other than the media supply path for which the lid member is provided in the supply port. Therefore, it is possible to inhibit the occurrence of a recording media jam state in the shared passage part shared as the recording media supply path with the plurality of supply paths.

It is preferable that with the recording device noted above, the movement control unit has the operation of moving the recording media to the supply port side from the shared passage part performed regardless of whether or not at least a portion of the recording media supplied to the media supply path by being inserted from the supply port exists in the shared passage part.

With this constitution, the recording media inserted in the media supply path from the supply port can be moved so as to return to the upstream side of the shared passage part, in other words, the supply port side of the side opposite the recording unit. Therefore, the recording media inserted inside the shared passage part inserted in the supply port is evacuated to outside the shared passage part, and is also held in a state inserted in the media supply path having a supply port. As a result, the trouble of again inserting and setting in the supply port the recording media ejected to outside the recording device is inhibited.

It is preferable that the recording device noted above is equipped with a moving unit capable of moving at least the recording media positioned inside the shared passage part by being driven and supplying it to the recording unit, wherein the movement control unit evacuates that recording media to outside the shared passage part by driving the moving unit and moving the recording media inserted in the media supply path inserted from the supply port.

With this constitution, using the moving unit capable of moving the recording media and supplying it to the recording unit, the recording media inserted in the media supply path from the supply port is moved so as to be evacuated to outside the shared passage part. Therefore, it is not necessary to separately provide a movement mechanism for evacuating the recording media from the shared passage part, so it is possible to inhibit the recording device from becoming complex.

It is preferable that the recording device noted above be equipped with a media detection unit for detecting recording media moved within the shared passage part, wherein when the media detection unit detects that recording media has been inserted from the supply port and supplied to the media supply path, the movement control unit drives the moving unit to perform the operation of moving the recording media to outside the shared passage part even when the open lid state is not detected.

With this constitution, the recording media is detected inside the shared passage part, so it is possible to reliably evacuate the recording media actually inserted in the supply path from the supply port to outside the shared passage part.

BRIEF DESCRIPTION OF THE DRAWINGS

Referring now to the attached drawings which form a part of this original disclosure:

FIG. 1A shows the state when paper is supplied from a paper feed cassette, and FIG. 1B shows the state when paper is manually inserted from the insertion port;

FIG. 2 is a cross section diagram of a printing device showing a plurality of paper conveyance paths that the printing device of the embodiment is equipped with;

FIG. 6A is a partial cross section diagram showing a state with the paper inserted in the shared passage part of the paper conveyance path from the insertion port being evacuated to outside the shared passage part by being moved to the insertion port side, and FIG. 6B is a partial diagram showing another state of the paper being evacuated to the outside the shared passage part.

DETAILED DESCRIPTION OF EXEMPLARY EMBODIMENTS

Hereafter, as an example of the invention in specific form, we will describe a printing device as an example of a recording device that is equipped with a liquid spray head for spraying liquid, and that prints (records) images including text or graphics or the like by spraying liquid on paper in sheet form as an example of the recording media.

Figure 1A:
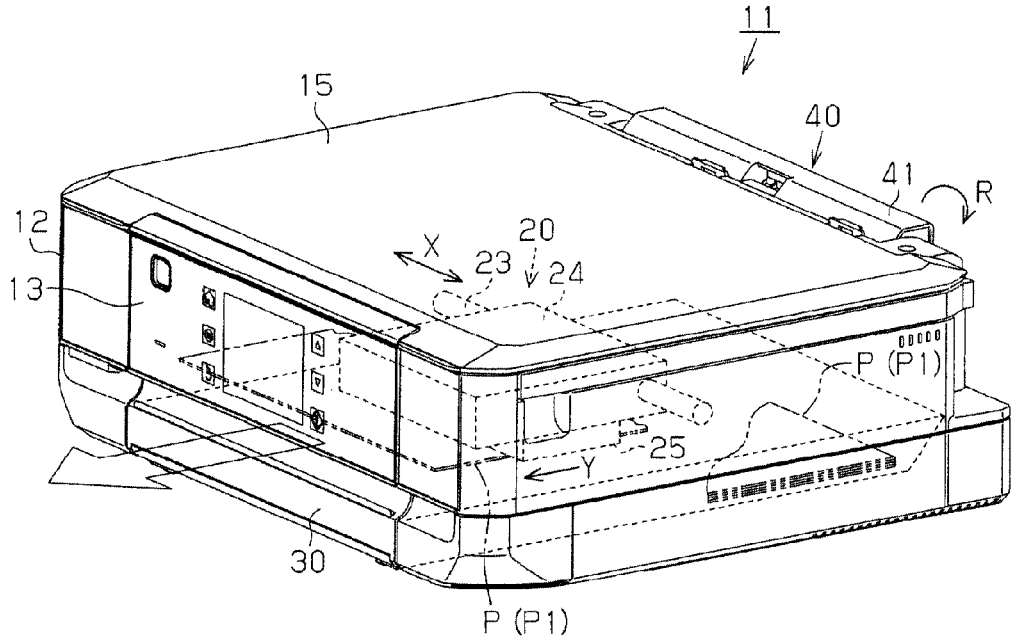
FIGS. 1A and 1B are perspective views of a printing device which is an embodiment of the invention, where
Figure 1B:
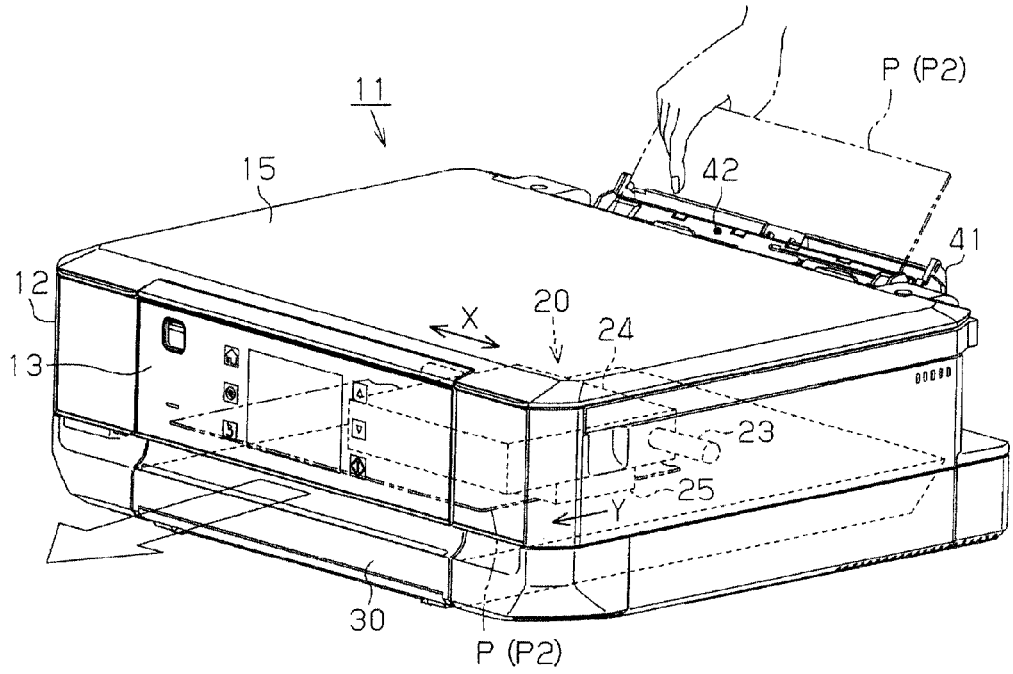

As shown in FIGS. 1A and 1B, the printing device 11 of this embodiment is equipped with a printing unit 20 as an example of a recording unit for printing an image by spraying ink as an example of a liquid on paper P inside the device main unit 12 exhibiting a roughly solid rectangular shape enclosed by a plurality of housings, and a paper feed cassette 30 as an example of a paper supply source for which it is possible to place paper P in a layered state. Also, an operating panel 13 for operating the printing unit 20 or the like is arranged at the front surface side of the device main unit 12 which is the ejection direction side at which the paper P is ejected from the printing unit 20, and an image reading unit 15 such as a scanner or the like is installed on the top surface side which is the antigravity direction side of the device main unit 12.

The operating panel 13 is equipped with a display unit (e.g. a liquid crystal display) for displaying a menu screen or the like, an operating unit (e.g. an operating button), and the like. Also, the operating panel 13 has a constitution for which the lower side is lifted up to the front and opened by a rotating mechanism such as a hinge (not illustrated) provided on the upper side, and is attached to be able to open and close on the device main unit 12. On the back side of the side opposite to the front side at which the operating unit or the like of the operating panel 13 is provided, a paper ejection port for ejecting paper P ejected from the printing unit 20 to outside the main unit 12 is installed on the device main unit 12, and from the paper ejection port (not illustrated) exposed by the operating panel 13 opening, the paper P is ejected to the front as shown by the white outline arrow in FIGS. 1A and 1B.

The paper feed cassette 30 is installed to be able to be inserted and removed in relation to the device main unit 12 at the bottom of this operating panel 13, and the placed paper P1 is fed and conveyed in the paper conveyance path as an example of a media supply path installed on the insertion direction inward side (back side), and is supplied to the printing unit 20.

Furthermore, in addition to supplying paper P to the printing unit 20 from the paper feed cassette 30, the printing device 11 is equipped with a manual paper feed mechanism 40 that supplies paper P one sheet at a time by manual feeding at the upper site of the back side of the side facing opposite the front side at which the operating panel 13 is provided with the device main unit 12. The manual paper feed mechanism 40 is equipped with an opening space in which paper P is inserted as an insertion port 42, and an opening and closing lid 41 which is an example of a lid member that opens and closes this insertion port 42 is equipped to be able to swing freely on the device main unit 12.

The opening and closing lid 41 is in a closed lid state with the insertion port 42 closed as shown in FIG. 1A when not performing supplying of the paper P with the manual paper feed mechanism 40 so that foreign matter such as dust or the like does not enter the insertion port 42. Meanwhile, when supplying paper P to the printing unit 20 with the manual paper feed mechanism 40, the opening and closing lid 41 is in an open lid state with the insertion port 42 open as shown in FIG. 1B by the opening and closing lid 41 swinging to the back as shown by the arrow R in FIG. 1A. Then, by paper P being inserted in the insertion port 42 exposed by the opening and closing lid 41 being in an open state, there is a state by which paper P can be supplied to the printing unit 20. Therefore, the insertion port 42 functions as an example of a paper P supply port.

With the description hereafter, as shown in FIGS. 1A and 1B, the paper P is distinguished as necessary with the placement paper placed in the paper feed cassette 30 being called paper P1, and the paper manually fed and inserted in the manual paper feed mechanism 40 being called paper P2.

With the printing device 11, printing is performed with the printing unit 20 on the supplied paper P (P1 and P2). The printing unit 20 has the following constitution. Specifically, a guide axis 23 is built extending along the width direction (this is also called the main scan direction X) orthogonal to the conveyance direction of the conveyed paper P within the device main unit 12. Also, a carriage 24 is supported in a state able to move along the main scan direction X on the guide axis 23. The carriage 24 moves back and forth along the main scan direction X following the drive of the carriage motor (not illustrated).

A liquid spray head 25 for spraying ink is supported on the bottom surface side of the carriage 24. Then, by moving the carriage 24, the liquid spray head 25 is moved, and ink is sprayed on the supplied paper P from the moving liquid spray head 25. The paper P is moved (intermittent movement) in the conveyance direction (this is also called the sub scan direction Y) orthogonal to the main scan direction X along with the drive of the paper feed motor (not illustrated).

With the printing unit 20 constituted in this way, printing is performed on the paper P with the bidirectional movement of the carriage 24 movement in the main scan direction X and the paper P movement in the sub scan direction Y. The paper P for which printing was performed is ejected to outside the device main unit 12 from the paper ejection port. Also, when doing printing with the printing unit 20, the plurality of ink cartridges (not illustrated) in which ink supplied to the liquid spray head 25 is housed are installed inside the device main unit 12.

As described above, a plurality of paper supply sources for supplying paper P to the printing unit 20, specifically, the paper feed cassette 30 and the manual paper feed mechanism 40, are equipped in the printing device 11 of this embodiment. Then, the paper conveyance path as an example of the media supply path for conveying and supplying paper P1 to the printing unit 20 from the paper feed cassette 30, and the paper conveyance path as an example of the media supply path for conveying and supplying paper P2 to the printing unit 20 from the manual paper feed mechanism 40 are the two conveyance paths provided.

Figure 2:
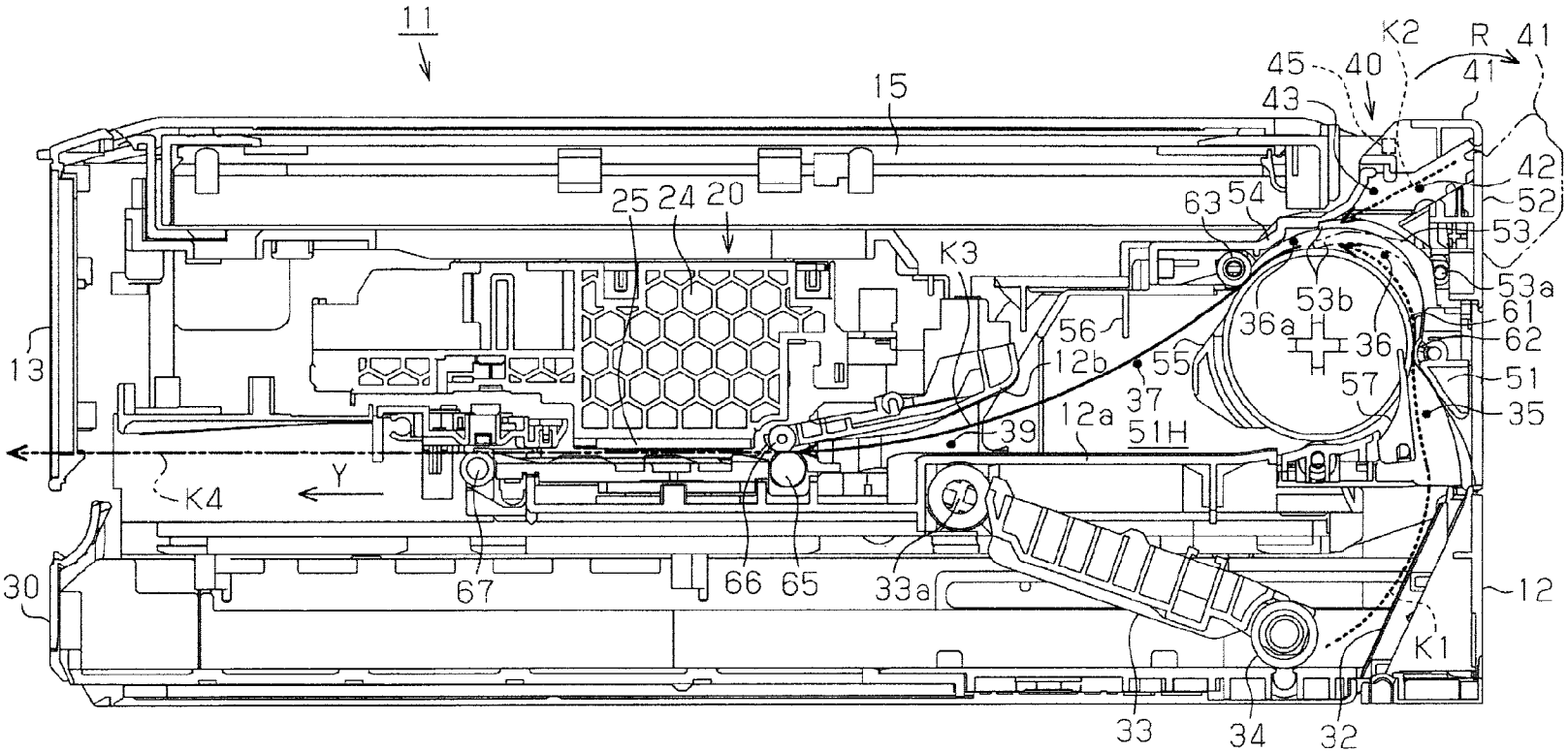

Next, we will describe these two conveyance paths (paper conveyance paths) while referring to FIG. 2. With FIG. 2, the opening and closing lid 41, which can be displaced in a state for which the paper P1 is not housed in the paper feed cassette 30, and a state shown by the double-dot dash lines swinging in the direction shown by the arrow R in the drawing with the manual paper feed mechanism 40, is shown in a closed lid state that is closed without displacement, specifically, a state for which the paper P2 is not inserted from the insertion port 42.

As shown in FIG. 2, the conveyance path of the paper P1 placed in the paper feed cassette 30 is formed by a plurality of constitution members 51 to 57, 12*a*, 12*b*, and the driver roller 61 and driven rollers 62 and 63 that rotate when the paper P1 is moved. The structural member 51 has a shape bent roughly at right angles at both sides so as to form side wall 51H at both sides in the width direction orthogonal to the conveyance direction of the paper P1, specifically, the main scan direction X (direction orthogonal to the paper surface in FIG. 2). Also, the back surface of the structural member 52 constitutes one part of the outside surface of the case with the device main unit 12. Then, the structural member 53 has its base edge side used as a movable member supported so as to be able to rotate (swing) with the rotation axis 53*a* as the center along the width direction of the paper P1 in relation to the structural member 52. Also, the drive roller 61 is axially supported to be able to rotate on the side wall 51H with the axial line as the center along the main scan direction X based on the drive force from the drive source (not illustrated). Then, the drive roller 61 conveys the paper P1 by respectively grasping and rotating the paper P1 with a driven roller 62 similarly axially supported to be able to rotate freely on the structural member 51 with the axial line as the center along the main scan direction X, and a driven roller 63 axially supported to be able to rotate freely on the structural member 54 with the axial line as the center along the main scan direction X. The driven roller 62 functions as a retard roller, and the paper P1 is conveyed one sheet at a time by the drive roller 61.

The conveyance path of the paper P1 is constituted by this kind of structural members 51 through 57, 12*a*, 12*b*, and the rollers 61 through 63, and by the conveyance paths 35, 36, 37, and 39 formed in sequence facing the printing unit 20 which becomes the conveyance direction downstream side from the paper feed cassette 30 side.

The conveyance path 35 is formed between the front side wall surface of the structural member 51 and the back side wall surface of the structural member 57 arranged at the front side of this structural member 51, and is formed as a spatial area having an opening at the gravity direction side which is the paper feed cassette 30 side. The conveyance path 35 of this paper P1 is the paper conveyance path by which the paper P1 is initially conveyed by being moved upward along a separation incline 32 from the paper feed cassette 30 by the paper feed roller 34 equipped at the tip edge of the paper feed unit 33 that swings with the rotation center 33*a* as the center along the main scan direction X within the device main unit 12. A conveyance path 36 sandwiching the roller pair of the driver roller 61 and the driven roller 62 is provided at the conveyance direction downstream side of this conveyance path 35.

The conveyance path 36 is formed above the conveyance path 35 with this embodiment, and is a curved path having a spatial area in a curved shape corresponding to the outer circumference surface shape of the drive roller 61. The conveyance path wall surface of the inside of the curved shape (curved path) of the conveyance path 36 is constituted by the drive roller 61 and structural members (not illustrated) formed at both sides of the width direction of the paper P. Also, the conveyance path side wall that is the outside surface of the curved shape (curved path) with the conveyance path 36 is constituted by the wall surface (bottom surface) of the structural member 53 (movable member) installed so as to face opposite the outer circumference surface of the drive roller 61 and a portion of the wall surface (bottom surface) of the structural member 54. The structural member 53 has its rotation axis 53*a* supported so as to be able to rotate freely on the structural member 52 at the conveyance direction upstream side with the conveyance path 36, and can be displaced by swinging of the edge part 53*b* of the conveyance direction downstream side with the rotation axis 53*a* as the center. Then, by the structural member 53 being displaced in this way, between the structural member 53 and the structural member 54 can be opened and closed. As shown in FIG. 2, the structural member 53 has the end part 53*b* of the conveyance direction downstream side biased upward, which becomes the structural member 54 side, by a biasing means (not illustrated), and is in a state whereby between the structural member 53 and the structural member 54 is always closed.

The conveyance path 37 is provided sandwiching the pair of rollers of the drive roller 61 and the driven roller 63 at the conveyance direction downstream side of the conveyance path 36. The conveyance path 37 is formed in a state with the front direction tip down subsequent to the conveyance path 36 which is a curved path, and the space formed between a partial wall surface (bottom surface) of the front side of the structural member 54 and the bottom surface of the structural member 56 and the front side wall surface of the structural member 55 is a spatial area. This conveyance path 37 is in communication with the conveyance path 39 formed at the front.

With the conveyance path 39, one (upper) of the conveyance path wall surfaces is constituted by the bottom surface of the structural member 12*b* of the device main unit 12, and the other (lower) of the conveyance path wall surfaces is constituted by the upper surface of the structural member 12*a*. Then, the paper P1 sent to the conveyance path 37 is grasped by the paper feed rollers 65 and 66 as an example of the pair of conveyance rollers axially supported to be able to rotate on the device main unit 12 by being conveyed to the conveyance path 39 in communication with the conveyance path 37, and is conveyed to the printing unit 20.

With this embodiment, for example a circuit substrate (not illustrated) within the operating panel 13 and a drive source (not illustrated) (e.g. a motor) within the device main unit 12 are respectively equipped, and by the operating panel 13 (circuit substrate) functioning as an example of the movement control unit, the drive source is controlled, and at least the drive roller 61 is rotated and driven.

So then, in addition to the conveyance path (paper conveyance path) by which the paper P1 from the paper feed cassette 30 is supplied to the printing unit 20 in this way, a conveyance path (paper conveyance path) by which the paper P2 inserted in the insertion port 42 with the manual paper feed mechanism 40 is supplied to the printing unit 20 is provided as an example of the media supply path for supplying the paper P to the printing unit 20. With this embodiment, this paper P2 conveyance path is constituted to flow together with the conveyance path 36 further to the conveyance direction upstream side than the driven roller 63, midway in the conveyance path 36 by which the paper P1 is conveyed.

Specifically, the paper P2 conveyance path is formed by the structural member 53 and the structural member 54, and has a conveyance path 43 having the insertion port 42 at one end. Then, this conveyance path 43 is in communication with the conveyance path 36 by the structural member 53 which is a movable member rotating with the rotation axis 53*a* as the center, and as shown by the double dot dash line in FIG. 2, having an open state between the edge part 53*b* of the conveyance direction downstream side of the paper P1 with the structural member 53 and the structural member 54 positioned further upward than the structural member 53. Then, by this communication, the paper P2 conveyance path flows together with the paper P1 conveyance path.

Therefore, with the conveyance path 36, the conveyance path 36*a* which is formed further to the paper P1 conveyance direction downstream side than the conveyance path 43 joint flow position, specifically, the position of the end part 53*b* of the structural member 53, also becomes the paper P2 conveyance path. Furthermore, the conveyance path 37 and the conveyance path 39 formed to the conveyance direction downstream side of the conveyance path 36 also similarly become the paper P2 conveyance path.

As a result, as shown by the bold dotted line arrow K1 and the bold solid line arrow K3 in FIG. 2, the conveyance path by which paper P1 is supplied from the paper feed cassette 30 to the printing unit 20 is formed by the conveyance paths 35, 36, 36*a*, 37, and 39 on the printing device 11. Also, the conveyance path by which the paper P2 is supplied from the insertion port 42 to the printing unit 20 with the manual paper feed mechanism 40 is formed by the conveyance paths 43, 36*a*, 37, and 39 as shown by the bold dotted line arrow K2 and the bold solid line arrow K3 in FIG. 2. Then, the conveyance path 36*a*, 37, and 39 shown by the bold solid line arrow K3 is the shared passage part shared as the paper P1 conveyance path and the paper P2 conveyance path.

Therefore, with this embodiment, the drive roller 61 and the driven roller 63 function as an example of the moving unit that moves the paper P1 and the paper P2 in the shared passage part (here, the conveyance paths 36*a*, 37, and 39) and conveys them to the printing unit 20. The paper P (P1, P2) which has been conveyed to the printing unit 20 and for which printing is completed is conveyed in the sub scan direction Y by the pair of paper ejection rollers 67 (only one is shown in FIG. 2) axially supported to be able to rotate on the device main unit 12, and as shown by the bold double dot dash arrow K4 in FIG. 2, is ejected to outside the printing device 11 from the paper ejection port.

So then, with the printing device 11, for example due to the area occupied by the image reading unit 15 installed at the top surface side, for example, the spatial area allowed for the insertion port 42 and the conveyance path 43 is small, and the space needs to be made smaller, so installing sensors for detecting the paper P2 in the insertion port 42 and the conveyance path 43 is difficult. In light of that, with this embodiment, a detection sensor 45 as an example of an open lid detection unit is provided inside the displacement area of the opening and closing lid 41 site displaced along with swinging (rotation movement) as shown by the arrow R and the double dot dash line in FIG. 2, for example. As the detection sensor 45, it is possible to use an optical sensor of a constitution by which it works in coordination with opening and closing of the opening and closing lid 41, and does blocking and transmission of light, or a micro switch exhibiting an electrically conductive state and a nonconductive state or the like. With this embodiment, the detection sensor 45 outputs signals at least showing that the opening and closing lid 41 has exposed the insertion port 42 and is in an open lid state.

Figure 3:
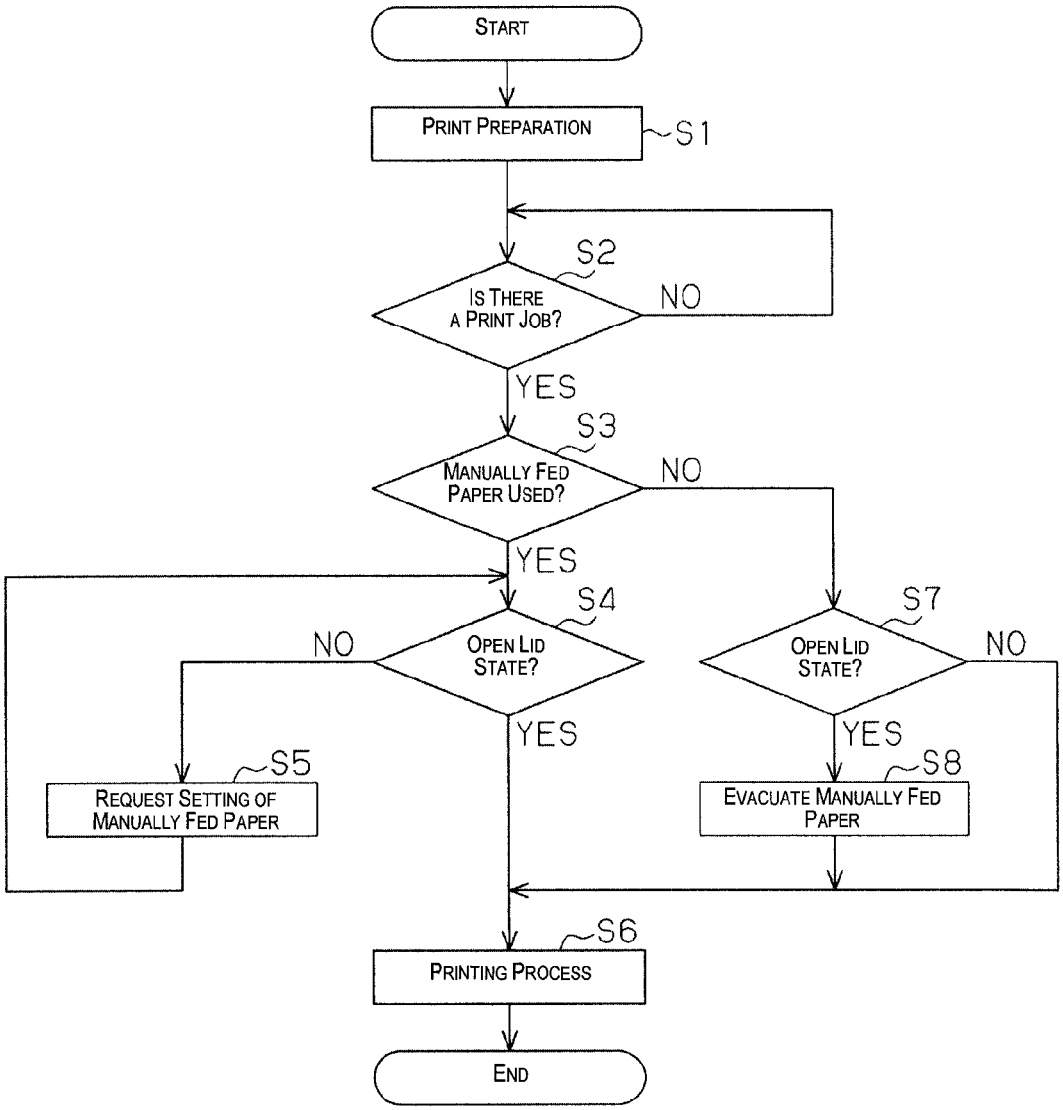
FIG. 3 is a flow chart showing the printing process performed by the printing device of the embodiment.
Figure 4:
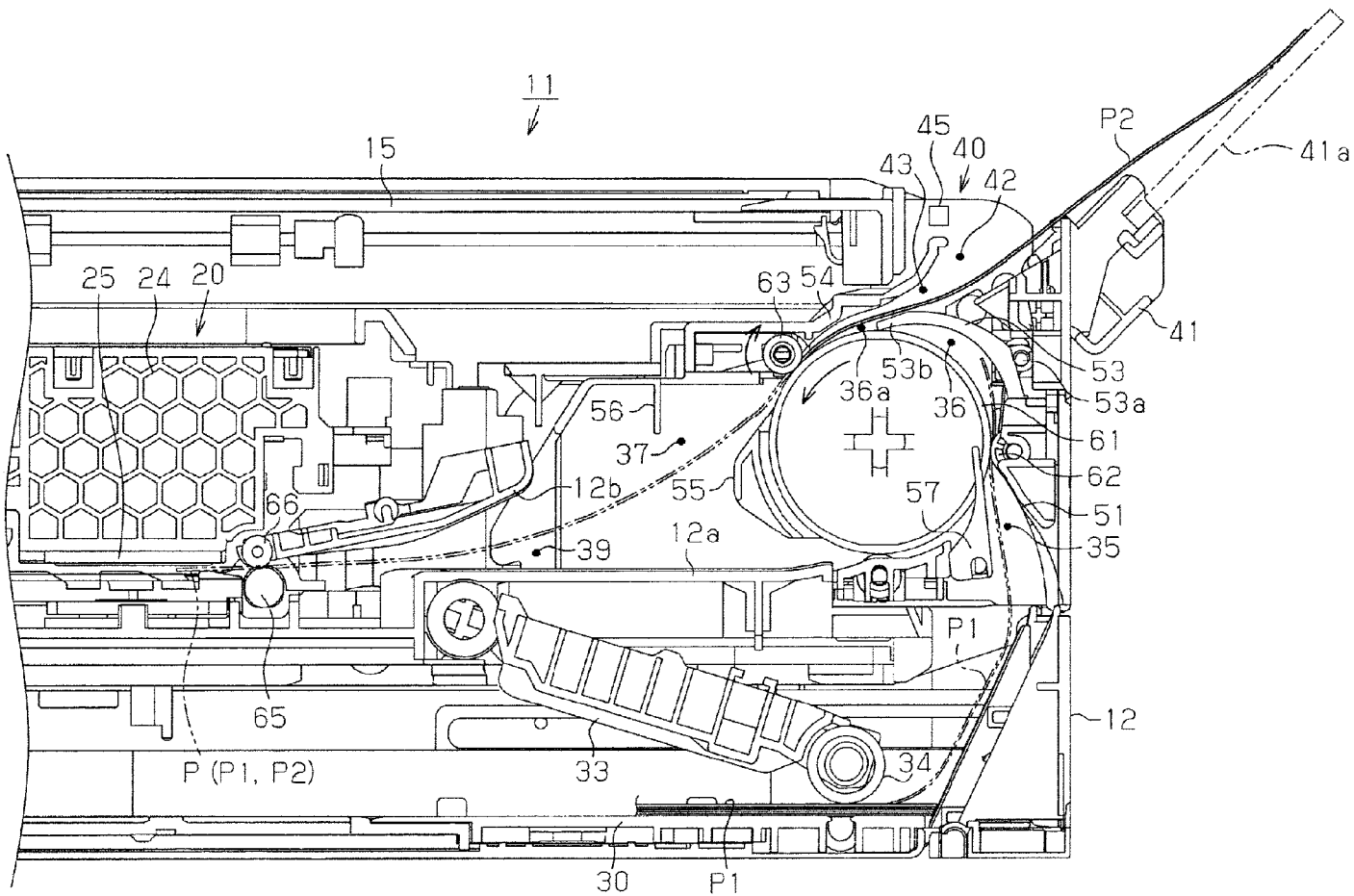
FIG. 4 is a partial cross section diagram showing the paper set state that is performed with printing preparation.
Figure 5:
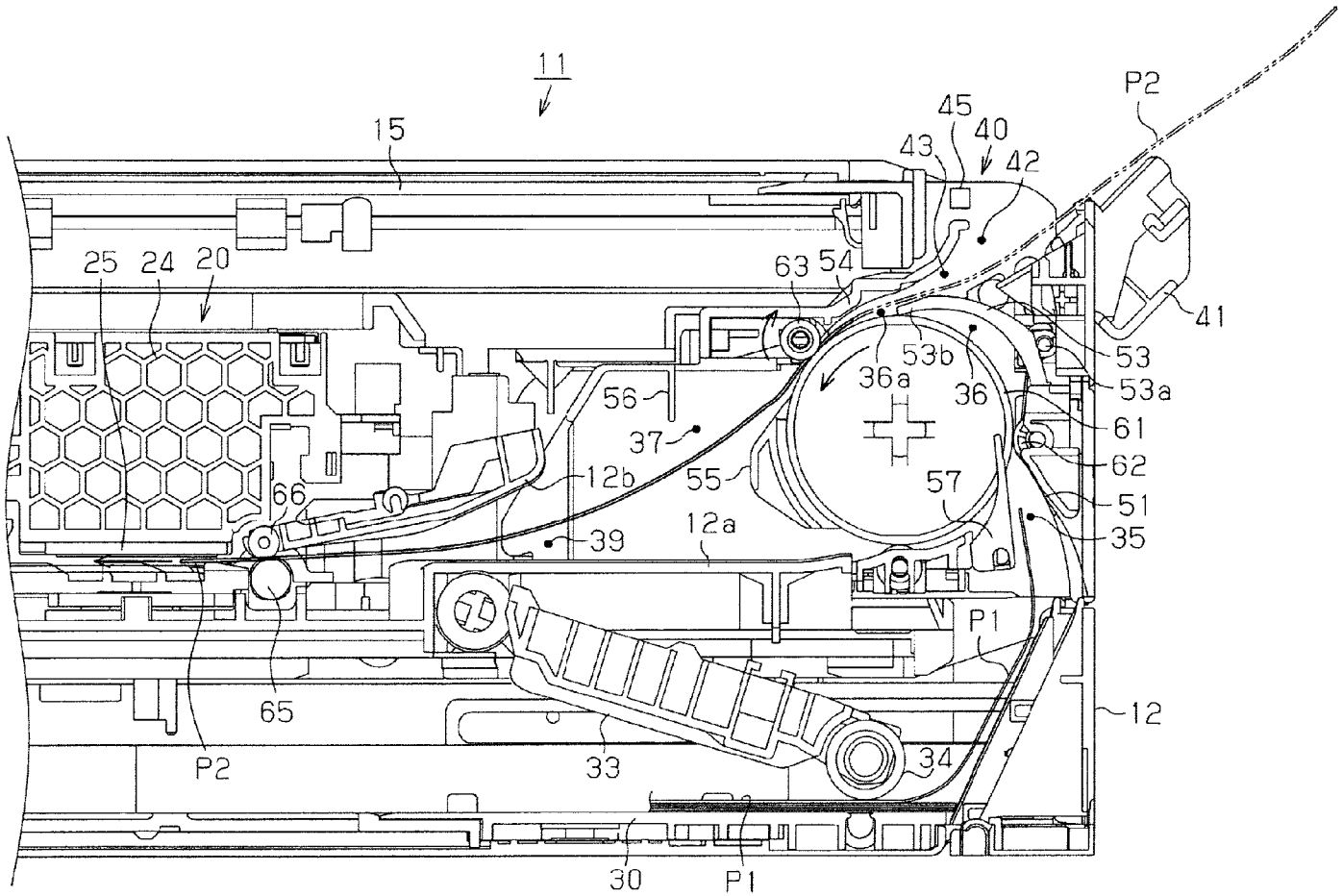
FIG. 5 is a partial cross section diagram showing the paper moving operation when paper inserted in the shared passage part of the paper conveyance path from the insertion port is ejected to outside the shared passage part.

Next, we will describe the operation of the printing device 11 of this embodiment constituted as noted above together with the printing process executed following the flow chart of FIG. 3 while referring as appropriate to FIG. 4 and FIG. 5.

As shown in FIG. 3, when the print processing routine of this printing device 11 is started, first, the printing preparation process is performed at step S1. As the printing preparation, for example by displaying the necessary preparation contents on the display unit of the operating panel 13, the user of the printing device 11 is made to place the paper P in the paper feed cassette 30 and to mount it in the device main unit 12, and to set the paper P2 in the manual paper feed mechanism 40. Also, the panel 13 is lifted up and the paper ejection port is exposed. We will describe the paper P setting state by the printing preparation process of this step S1 while referring to FIG. 4.

As shown in FIG. 4, with the print preparation process of step S1, the paper P1 is placed in the paper feed cassette 30, and is set in a state able to be supplied to the printing unit 20 through the conveyance paths 35, 36, 37, and 39. Specifically, as shown by the double dot dash lined in FIG. 4, the paper P1 is sent to the conveyance path 35 by the paper feed roller 34, and along with rotation of the drive roller 61 in the direction shown by the arrow in FIG. 4, this is grasped with the driven roller 62, and conveyed to the conveyance path 36 from the conveyance path 35. After that, the paper P1 is grasped between the drive roller 61 and the driver roller 63, and as with the paper P shown by the double dot dash line in FIG. 4, this is conveyed from the conveyance path 36 to the conveyance path 37 and the conveyance path 39.

Meanwhile, with the paper P2, the user opens the opening and closing lid 41 with the manual paper feed mechanism 40, inserts the edge of the paper P2 in the exposed insertion port 42, and is inserted in the conveyance path 43. Having done that, the paper P2 inserted in the conveyance path 43 has its insertion direction edge part rotated so as to press down the structural member 53 by the weight of the paper P2. As a result, an opening is made between the structural member 53 and the structural member 54, and via this opening, the paper P2 is inserted inside the conveyance path 36*a* in communication with the conveyance path 43. Then, the paper P2 inserted in the conveyance path 36*a* from the conveyance path 43 has its insertion direction edge part pulled to the pair of rollers of the drive roller 61 and the driven roller 63, and is set in a state when it is moved along the surface of the drive roller 61 up to a position at which grasping is possible. Specifically, the paper P2, along with rotating in the paper P2 conveyance direction shown by the solid line arrow in FIG. 4, as with the paper P (P2) shown by the double dot dash line in FIG. 4, is grasped between the drive roller 61 and the driven roller 63 and is in a state that can be conveyed from the conveyance path 36 (conveyance path 36*a*) to the conveyance path 37.

So that the paper P2 inserted in the conveyance path 43 from the insertion port 42 is stably set without being pulled out from the insertion port 42, when necessary, for example, a rod shaped or plate shaped support member 41*a* for supporting the paper P2 can be attached to the opening and closing lid 41 with the manual paper feed mechanism 40.

Returning to FIG. 3, next, at step S2, a judgment is made of whether or not there is a print job. With this embodiment, as an example, each process of the print process routine shown in FIG. 3 is executed by the control unit formed by a CPU (central processing unit), memory, and the like provided on a circuit substrate equipped on the operating panel 13. Specifically, at step S2, the control unit judges whether or not print job data is input to the printing device 11 from a personal computer or the like.

As a result of the judgment at step S2, if there is no print job (step S2=No), the judgment process of step S2 is repeated, and if the judgment results are that there is a print job (step S2=Yes), at the next step S3, a judgment is made of whether the print job uses manually fed paper. Here, the control unit judges from the input print job data whether the used paper is manually fed paper, specifically, paper P2, or whether it is the paper feed cassette 30 paper P1.

As a result of the judgment process at step S3, when manually fed paper is used (step S3=Yes), the process shifts to step S4, and a judgment is made of whether or not the opening and closing lid 41 is in an open lid state. Meanwhile, when the results of the judgment at step S3 is not using manually fed paper (step S3=No), the process shifts to step 7, and similarly, a judgment is made of whether or not the opening and closing lid 41 is in an open lid state. Here, at step S4 and step S7, the control unit makes a judgment of whether or not there is an open lid state by detecting output signals of the detection sensor 45.

First, as a result of the judgment process at step S4, if the opening and closing lid 41 is not in an open lid state (step S4=No), the paper P2 (manually fed paper) is not set, so at step S5, the manual feed paper set request process is performed and the process again returns to step S4. With this step S5, for example, the control unit performs the process of displaying a statement prompting setting of the paper P2 in the insertion port on the display unit of the operating panel 13, generating notification sounds prompting setting of the paper P2, or the like.

Then, as a result of the judgment at step S4, if the opening and closing lid 41 is in an open lid state (step S4=Yes), the paper P2 (manually fed paper) is regarded as having been set, and the process shifts to step S6 and the printing process is performed. Here, the movement control unit rotates the drive roller 61, and by moving the paper P2, conveys it to the printing unit 20, and also the control unit controls the printing unit 20 to have ink sprayed from the liquid spray head 25 on the paper P2 to print. The paper P1 at this time is positioned further to the conveyance direction upstream side than at least the drive roller 61 and the driven roller 62, and by doing this, the constitution is such that movement (conveyance) accompanying rotation of the drive roller 61 does not occur.

Next, as a result of the judgment process at step S7, if the opening and closing lid 41 is in an open lid state (step S7=Yes), the paper P2 (manually fed paper) is regarded as having been set, so the process shifts to step S8, and the manually fed paper evacuation process is performed. Here, the movement control unit rotates the drive roller 61, and by the paper P2 being moved, the paper P2 is moved from the conveyance path 36*a* to the conveyance paths 37 and 39, and furthermore, the paper feed rollers 65 and 66 are rotated and the paper P2 is moved from the conveyance path 39 to the printing unit 20 side. By doing this, the paper P2 is evacuated to outside the shared passage part. We will describe this manually fed paper evacuation process at step S8 while referring to FIG. 5.

As shown in FIG. 5, with the process at step S8, first, by the drive roller 61 rotating in the direction shown by the solid line arrow in FIG. 5, the paper P2 is pulled in and grasped with the driven roller 63. Then, by the drive roller 61 rotating further, the paper P2 that has been inserted into the insertion port 42 and inserted in the conveyance path 43 and the conveyance path 36*a* is moved from the conveyance path 37 to the conveyance path 39 as shown by the solid line in FIG. 5. The paper P2 moved to the conveyance path 39 has its insertion direction edge part grasped by the paper feed rollers 65 and 66, and is conveyed toward the paper ejection port as shown by the solid line arrow in FIG. 5. In this way, the paper P2 is evacuated from the conveyance paths 36*a*, 37, and 39 which are the shared passage part.

At this time, with this embodiment, by an open lid state of the opening and closing lid 41 being detected by the detection sensor 45, though the fact that the paper P2 is set in the manual paper feed mechanism 40 is detected, the length of the set paper P2 in the conveyance direction (insertion direction) is not detected. In light of that, with this embodiment, to reliably evacuate the paper P2 from the shared passage part, the drive roller 61 is rotated by a rotation amount sufficient as needed to move it at least the maximum length in the paper P2 insertion direction (conveyance direction) in which it can be inserted from the insertion port 42.

Meanwhile, the paper P1 placed in the paper feed cassette 30, whether in a state left placed or in a state moved toward the conveyance path 35 by the paper feed roller 34, is in a state accumulated further to the conveyance direction upstream side than the pair of rollers of the drive roller 61 and the driven roller 62 within the conveyance path 35. Therefore, with the process at this step S8, the paper P1 is inhibited from being conveyed to the conveyance paths 36*a*, 37, and 39 which are the shared passage part with the paper P2.

Returning to FIG. 3, the printing process is performed at the subsequent step S6. Specifically, with the printing device 11 for which the paper P2 is evacuated from the shared passage part by step S8, the movement control unit rotates the drive roller 61 and supplies the paper P1 to the printing unit 20 by conveying it from the paper feed cassette 30, and also, the control unit controls the printing unit 20 and has ink sprayed from the liquid spray head 25 on the paper P1 to do printing. With this process, the paper P2 inserted in the insertion port 42 is already evacuated from the shared passage part, so the paper P1 conveyed from the paper feed cassette 30 is supplied to the printing unit 20 without being conveyed together with the paper P2 in the shared passage part. In this way, the printing process on the paper P1 or the paper P2 with the printing device 11 ends.

With the embodiment noted above, the following kinds of effects can be obtained.

(1) Even when it is not possible to install the sensor for detecting the paper P2 in the conveyance path 43 for which the insertion port 42 is provided, by detecting that the opening and closing lid 41 is in an open lid state, it is possible to detect that the paper P2 is in a state inserted from the insertion port 42 to the paper P2 conveyance path. Then, the paper P2 in a state inserted from the insertion port 42 to the conveyance paths 43 and 36*a* is moved so as to be evacuated to outside the shared passage part (specifically, the conveyance paths 36*a*, 37, and 39) when the paper P1 is supplied to the printing unit 20 from the other conveyance path 35 side other than the conveyance path 43 in which the insertion port 42 is provided. Because of that, the paper P2 inserted via the insertion port 42 to the conveyance path 43 in which the insertion port 42 is provided does not obstruct the supply of the paper P1 supplied to the printing unit 20 through the shared passage part from the paper feed cassette 30 of other than the conveyance paths 43 and 36*a* for which the opening and closing lid 41 is provided on the insertion port 42. Therefore, it is possible to inhibit the occurrence of a jam state of the paper P in the shared passage part shared as the supply path of the paper P (P1 and P2) with the plurality of media supply paths.

(2) Using the drive roller 61 and the driven roller 63 capable of moving the paper P and supplying it to the printing unit 20, the paper P2 inserted up to the conveyance path 36*a* which is the shared passage part via the conveyance path 43 from the insertion port 42 is moved so as to be evacuated to outside the shared passage part. Therefore, it is not necessary to separately provide a movement mechanism for evacuating the paper P2 from the shared passage part, so it is possible to inhibit the printing device 11 from becoming complex.

The embodiment noted above can also be modified as described below.

When doing the printing process with the embodiment noted above, with the circuit substrate, it is preferable that the paper P2 inserted up to the conveyance path 36*a* which is the shared passage part via the conveyance path 43 from the insertion port 42 be evacuated to outside the shared passage part by being moved to the insertion port 42 side from the shared passage part (in this case, the conveyance path 36*a*). We will describe this modification example while referring to FIGS. 6A and 6B.

Figures 6A, 6B:
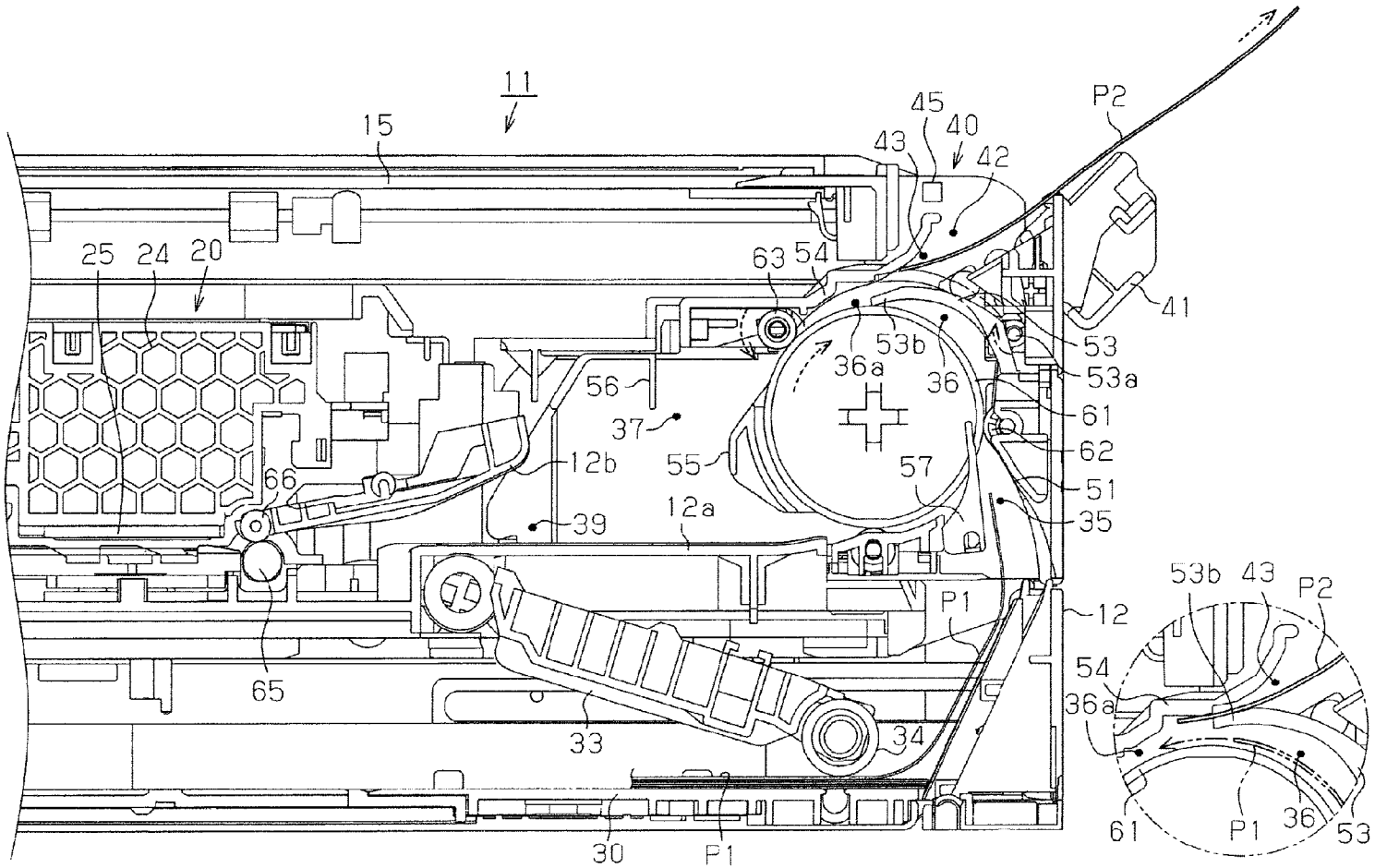
FIGS. 6A and 6B are modification examples, where

As shown in FIG. 6A, with this modification example, the evacuation process of the manual feed paper with step S8 (FIG. 3) is different from the embodiment noted above. Specifically, rather than the paper P2 inserted up to the conveyance path 36*a* via the conveyance path 43 from the insertion port 42 being conveyed to the paper ejection port side, conversely to this, it is moved to the insertion port 42 side.

In specific terms, the drive roller 61 is rotated in the reverse direction (direction shown by the dotted line arrow in FIG. 6A) to the rotation direction driven when supplying the paper P2 to the printing unit 20. By this rotation, the paper P2 is moved to the insertion port 42 side, specifically, the end part 53*b* side of the structural member 53, along with the rotation of the drive roller 61 while its insertion direction edge part is in contact with the outer circumference above the drive roller 61. Then, with this modification example, when the insertion direction edge part of the paper P2 moves up to the edge part 53*b* of the structural member 53, rotation is done with the rotation axis 53*a* as the center in the direction by which the structural member 53 closes the opening with the structural member 54 (direction shown by the dotted line arrow in FIG. 6A). Specifically, the constitution is such that the structural member 53 is rotated by the drive source (not illustrated) equipped in the device main unit 12, and by that rotation, the edge part 53*b* is swung as shown by the double dot dash line in FIG. 6A so as to push the paper P2 upward. Alternatively, it also possible to have the constitution such that by strengthening the biasing force of the biasing means (not illustrated), the end part 53*b* of the structural member 53 pushes the paper P upward.

As a result, by the end part 53*b* of the structural member 53 pushing the paper P2 up, the paper P2 is moved to the insertion port 42 side (the direction shown by the dotted line arrow in FIG. 6A) and evacuated to outside the shared passage part (conveyance path 36*a*). At this time, the drive roller 61 and the structural member 53 (end part 53*b*) move the paper P2 in a state held in a state inserted in the conveyance path 43 without falling out from the manual paper feed mechanism 40 (insertion port 42). Therefore with this modification example, the structural member 53 (end part 53*b*) and the drive roller 61 function as an example of a moving unit.

However, with this modification example, even if the position of the insertion direction edge part of the paper P2 pushed up by the end part 53*b* of the structural member 53 is inside the conveyance path 36*a*, when moving the paper P1 in the conveyance path 36*a*, if in a state where that movement is not obstructed, it is also possible to be in a state for which the paper P2 is moved and evacuated from the shared passage part.

For example, as shown in FIG. 6B, when the end part 53*b* of the conveyance direction downstream side of the structural member 53 is swung upward so as to be pushed back to the conveyance path 43 for which the paper P2 is positioned at the insertion port 42 side, it is possible for a state to occur in which the paper P2 is sandwiched by the structural member 54 and the structural member 53 (end part 53*b*). In this kind of state, even if the insertion direction end part of the paper P2 is accumulated inside the conveyance path 36*a*, as shown by the double dot dash line in FIG. 6B, if it is possible for the paper P1 to move between the outer circumference of the drive roller 61 and the structural member 53, in this way, even if the paper P2 is sandwiched by the structural member 54 and the structural member 53 (end part 53*b*), this is included in the state evacuated from the shared passage part.

With this modification example, after the printing process on the paper P1 ends, and the rotation operation by the drive source on the structural member 53 is canceled or the biasing force by the biasing means is weakened, the paper P2 moved to the insertion port 42 side pushes down the end part 53*b* of the structural member 53 again by its own weight and is inserted inside the conveyance path 36*a*. As a result, the paper P2 inserted in the conveyance path 36*a* is set again in a state moving along the surface of the drive roller 61 up to the position at which it is possible for its insertion direction end part to be pulled to and grasped by the roller pair of the drive roller 61 and the driven roller 63.

With this modification example, the following effect is exhibited in addition to the effects (1) and (2) of the embodiment noted above.

(3) The paper P2 inserted up to the conveyance path 36*a* which is the shared passage part via the conveyance path 43 from the insertion port 42 can be moved so as to return to the shared passage part (conveyance path 36*a*) conveyance direction upstream side, in other words, to the insertion port 42 side. Therefore, the paper P2 inserted inside the conveyance path 36*a* inserted in the insertion port 42 is evacuated to outside the shared passage part (conveyance path 36*a*) and also held in a state inserted in the conveyance path 43 having the insertion port 42. As a result, the trouble of again inserting and setting the paper P2 ejected to outside the printing device 11 in the insertion port 42 is inhibited.

With the printing device 11 of the embodiment noted above and the modification examples noted above, the media detection unit for detecting the paper P conveyed inside the shared passage part is equipped, and when the media detection unit detects the paper P2 inserted from the insertion port 42 and inserted into the conveyance paths 43 and 36*a*, it is preferable that the drive roller 61 is driven and the paper P2 is moved and evacuated to outside the shared passage part. Specifically, with the embodiment noted above and the modification examples noted above, the paper P2 undergoes the evacuation process when the opening and closing lid 41 is in an open lid state regardless of whether or not at least a portion of the paper P2 exists in the shared passage part. In contrast to this, with this modification example, the evacuation process is made to be performed when the paper P2 exists. We will describe this modification example while referring to FIG. 7. This modification example is performed with the manually fed paper evacuation process at processing step S8 (see FIG. 3) with the embodiment noted above.

Figure 7:
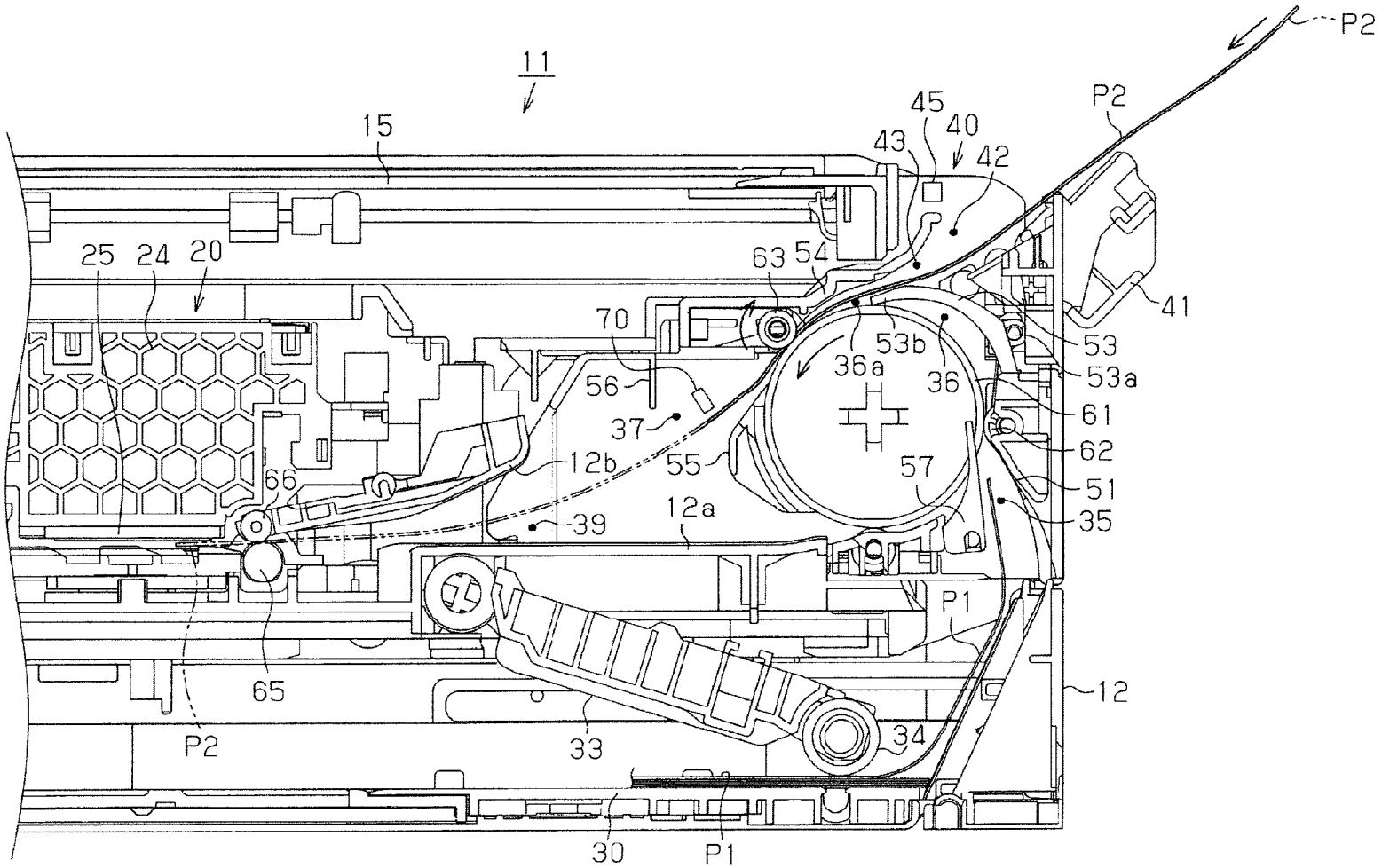
FIG. 7 is a partial cross section diagram of a modification example showing a state with the insertion direction edge part of the paper inserted in the paper conveyance path from the insertion port being detected within the shared passage part by a sensor.

As shown in FIG. 7, with this modification example, a sensor 70 is equipped inside the conveyance path 37 as an example of the media detection unit. This sensor 70 detects the presence of the paper P by sensing reflected light returned by emitted light being reflected by the paper P. Then, with the manually fed paper evacuation process at processing step S8 with the embodiment noted above, when the actually inserted paper P2 from the insertion port 42 is detected in the conveyance path 43 and 36*a*, the paper P2 is evacuated to outside the shared passage part.

In specific terms, with this modification example, with the evacuation process of the manually fed paper at step S8, first, as shown by the solid line arrow in FIG. 7, the drive roller 61 is rotated by a predetermined designated rotation amount (designated rotation angle). Along with this rotation of the drive roller 61, the paper P2 is grasped between it and the driven roller 63 and moved a designated amount to the conveyance path 37. The sensor 70 detects the insertion direction edge part of the paper P2 moving from the conveyance path 36*a* to the conveyance path 37 side. Said another way, the sensor 70 is installed at a position at which it can detect the insertion direction edge part of the paper P2 moving a designated movement amount. It is preferable to make the designated movement amount of the paper P2 be as small as possible.

Then, during this rotation of the drive roller 61 by a designated rotation amount, when the sensor 70 detects the insertion direction end part of the paper P2, the drive roller 61 continues to be rotated, and the paper P2 is evacuated from the conveyance paths 36*a*, 37, and 39 which are the shared passage part with the paper P1. Meanwhile, when the sensor 70 does not detect the paper P2, the paper P2 does not exist in the shared passage part, so after the drive roller 61 rotates the designated rotation amount, the processing of step S8 ends, and the process shifts to the printing process of step S6.

The evacuation process with this modification example is preferably performed even when the open lid state of the opening and closing lid 41 is not detected. Specifically, when the open lid state of the opening and closing lid 41 is not detected due to a failure of the detection sensor 45 or the like, for example, the paper P2 (manually fed paper) set in the insertion port 42 can also be made to be evacuated from the conveyance paths 36*a*, 37, and 39 which are the shared passage part with the paper P1.

With this modification example, the following effect is exhibited in addition to effects (1) and (2) of the embodiment noted above.

(4) The paper P inside the conveyance path 37 is detected, so when the paper P2 is actually inserted in the conveyance paths 43 and 36*a* from the insertion port 42, it is possible to reliably evacuate it to outside the shared passage part. Also, when there is no paper P2 actually in the conveyance paths 43 and 36*a*, it is possible to inhibit wasteful large volume rotation of the drive roller 61.

With the embodiment noted above, the constitution is such that the insertion port 42 is opened and closed by swinging of the opening and closing lid 41, but this is not limited to this, and for example it is also possible to have a constitution by which the insertion port 42 is opened and closed by a slide movement, for example.

With the embodiment noted above, the recording media is not limited to being the paper P, but can also be a metal plate, a resin plate, or a plate shaped member with a material such as fabric or the like. Specifically, as long as an item is a member for which printing (recording) is possible with the printing unit 2Q, it is possible to use that as one recording medium.

With the embodiment noted above, for the printing unit 20, it is possible to use an on carriage type for which an ink cartridge is placed on a cartridge 24, or to be an off carriage type by which the ink cartridge is not placed on the carriage 24. Alternatively, this is not limited to being a serial type printer for which the carriage 24 moves in the main scanning direction X, but can also be a line head type printer for which printing is possible in the maximum width range of the paper P with the liquid spray head 25 left in a fixed state.

With the embodiment noted above, the printing device (recording device) 11 can also be a device not equipped with an image reading unit 15, and can also be a composite device equipped with functions such as a fax device and copy device or the like together with the print unit 20.

With the embodiment noted above, the printing device (recording device) 11 can also be a device that sprays or discharges a liquid other than ink. The state of liquid discharged as tiny volume droplets from the liquid spraying device includes granular shapes, tear shapes, and threadlike shapes with a tail. Also, what is called liquid here is sufficient as long as it is a material that can be sprayed by the liquid spraying device. For example, it is sufficient as long as it is an item in a state when the property is liquid phase, and includes not only liquid bodies with high or low viscosity, and fluid bodies such as sol, gel water, other inorganic solvents, organic solvents, solutions, liquid resin, liquid metal (metal melt), and the like. This is not limited to liquids as one physical property state, but also includes items such as items for which particles of functional materials including a solid such as a pigment, metal particles or the like are dissolved, dispersed, or blended in a solvent. Also, as a representative example of a liquid, we can list the ink or liquid crystal or the like such as those described with the embodiment noted above. Here, ink includes typical water based inks and oil based inks, as well as various liquid compositions such as gel ink, hot melt ink and the like. As a specific example of the liquid spraying device, for example, there are liquid spraying devices which spray liquid including materials such as electrode materials or coloring materials or the like in a dispersed or dissolved form used in manufacturing items such as liquid crystal displays, EL (electro luminescence) displays, surface light emitting displays, color filters and the like. It is also possible to be a liquid spraying device for spraying bioorganic material used for biochip manufacturing, a liquid spraying device for spraying a liquid that will be a sample used for a precision pipette, a textile printing device, a micro dispenser or the like. Furthermore, it is also possible to use a liquid spraying device for spraying lubricating oil with a pinpoint on precision machines such as watches, cameras or the like, or a liquid spraying device for spraying a transparent resin liquid such a ultraviolet curing resin or the like for forming a miniature hemispheric lens (optical lens) used for optical communication elements or the like on a substrate. It can also be a liquid spraying device for spraying an acid or alkaline or the like etching fluid for etching a substrate or the like.

What is claimed is:

1. A recording device comprising:

a plurality of media supply paths for supplying recording media, a shared passage part shared by the plurality of media supply paths, a moving unit that moves the recording media, a recording unit that performs recording on recording media supplied through the shared passage part, a supply port that, with at least one of the media supply paths of the plurality of media supply paths, is able to supply that recording media to that media supply path by recording media being inserted, a lid member provided so that the supply port can be opened and closed, an open lid detection unit for detecting an open lid state when the lid member opens the supply port, and a movement control unit that, when the open lid detection unit detects the open lid state, before supplying of recording media is performed to the recording unit from another media supply path other than the media supply path on which the supply port is provided for which the open lid state is detected, drives the moving unit to perform the operation of moving the recording media to outside the shared passage part regardless of whether or not at least a portion of the recording media exists in the shared passage part.

2. The recording device according to claim 1, wherein the movement control unit has the operation of moving the recording media to the supply port side from the shared passage part performed regardless of whether or not at least a portion of the recording media supplied to the media supply path by being inserted from the supply port exists in the shared passage part.

3. The recording device according to claim 1, further comprising a media detection unit for detecting recording media moved within the shared passage part, wherein when the media detection unit detects that recording media has been inserted from the supply port and supplied to the media supply path, the movement control unit drives the moving unit to perform the operation of moving the recording media to outside the shared passage part even when the open lid state is not detected.

* * * * *